US008586518B2

(12) United States Patent
Westerman et al.

(10) Patent No.: US 8,586,518 B2
(45) Date of Patent: Nov. 19, 2013

(54) BIOBASED PENETRATING OIL

(75) Inventors: Tammy Westerman, Bratenahl, OH (US); Michael Nestor, Northfield, OH (US); John Nakoneczny, North Olmstead, OH (US)

(73) Assignee: State Industrial Products Corporation, Cleveland, OH (US)

( * ) Notice: Subject to any disclaimer, the term of this patent is extended or adjusted under 35 U.S.C. 154(b) by 224 days.

(21) Appl. No.: 13/218,764

(22) Filed: Aug. 26, 2011

(65) Prior Publication Data

US 2013/0053286 A1 Feb. 28, 2013

(51) Int. Cl.
*C10M 105/32* (2006.01)

(52) U.S. Cl.
USPC ..... 508/491; 508/390; 508/409

(58) Field of Classification Search
USPC ..... 508/491
See application file for complete search history.

(56) References Cited

U.S. PATENT DOCUMENTS

| | | | | | |
|---|---|---|---|---|---|
| 2,491,774 | A | | 12/1949 | Schulz | |
| 3,933,674 | A | * | 1/1976 | Farnsworth | 510/242 |
| 3,992,307 | A | | 11/1976 | Hotten | |
| 4,073,411 | A | * | 2/1978 | Doumani | 222/192 |
| 4,155,770 | A | * | 5/1979 | Doumani | 106/267 |
| 4,425,164 | A | * | 1/1984 | Bliznak et al. | 106/128.1 |
| 4,704,225 | A | | 11/1987 | Stoufer | |
| 4,752,465 | A | * | 6/1988 | Mackles | 424/45 |
| 5,085,849 | A | * | 2/1992 | Sampson et al. | 424/45 |
| 5,399,282 | A | * | 3/1995 | Hansen et al. | 510/400 |
| 5,489,394 | A | | 2/1996 | Ford | |
| 5,534,173 | A | | 7/1996 | Faber | |
| 5,691,285 | A | | 11/1997 | Coffey | |
| 5,773,391 | A | | 6/1998 | Lawate | |
| 5,801,131 | A | | 9/1998 | Coffey | |
| 5,976,339 | A | | 11/1999 | Andre, Sr. | |
| 6,010,984 | A | | 1/2000 | Heimann et al. | |
| 6,010,985 | A | | 1/2000 | Heimann et al. | |
| 6,017,857 | A | | 1/2000 | Heimann et al. | |
| 6,090,769 | A | | 7/2000 | Vlasblom | |
| 6,153,571 | A | * | 11/2000 | Komocki et al. | 510/190 |
| 6,278,006 | B1 | | 8/2001 | Kodali et al. | |
| 6,316,392 | B1 | | 11/2001 | Heimann et al. | |
| 6,350,392 | B1 | | 2/2002 | Schnur | |
| 6,413,916 | B1 | | 7/2002 | Baumgart et al. | |
| 6,465,401 | B1 | | 10/2002 | Kodali et al. | |
| 6,521,569 | B2 | | 2/2003 | Abramowski | |
| 6,551,523 | B1 | | 4/2003 | Schnur | |
| 6,656,888 | B1 | | 12/2003 | Zehler | |
| 6,919,300 | B2 | | 7/2005 | Dituro et al. | |
| 6,943,262 | B2 | | 9/2005 | Kodali | |
| 7,514,394 | B2 | | 4/2009 | Kodali et al. | |
| 8,057,836 | B2 | * | 11/2011 | Bogen et al. | 426/601 |
| 8,142,801 | B2 | * | 3/2012 | Jones | 424/406 |
| 8,158,185 | B2 | * | 4/2012 | Nakhasi et al. | 426/601 |
| 8,337,608 | B2 | * | 12/2012 | Bortz | 106/311 |
| 2003/0186824 | A1 | | 10/2003 | Chiu et al. | |
| 2006/0062994 | A1 | | 3/2006 | Gencer | |
| 2006/0105094 | A1 | * | 5/2006 | Holdar | 426/609 |
| 2008/0280791 | A1 | | 11/2008 | Hewette | |
| 2009/0131711 | A1 | * | 5/2009 | Wanasundara | 560/248 |
| 2009/0199462 | A1 | * | 8/2009 | Bist et al. | 44/385 |
| 2010/0247479 | A1 | * | 9/2010 | Mackert et al. | 424/84 |

* cited by examiner

*Primary Examiner* — Ellen McAvoy
(74) *Attorney, Agent, or Firm* — Pearne & Gordon LLP

(57) ABSTRACT

A biobased penetrating oil for use to reduce friction between fittings. The penetrating oil composition preferably contains one or more long-chain, low-volatile esters specifically derived from a natural plant-based oil, such as a combination of methyl esters derived from soybean oil, and an unsulfurized terpene, such a pine oil or limonene and various orange terpenes as a solvent. The penetrating oil can be an aerosolized product and included a carbon dioxide propellant.

20 Claims, No Drawings

BIOBASED PENETRATING OIL

FIELD OF THE INVENTION

The invention relates to penetrating oil containing a combination of biobased components. The penetrating oil is adapted for lubricating frictional parts such as fittings and reducing the torque needed to loosen the same.

BACKGROUND

Industrial penetrating and lubricating oils frequently use petroleum-based hydrocarbon oils and halogenated solvents. Such components are not environmentally friendly and pose health risks to people. Moreover, traditional petroleum-based formulations do not meet current or future anticipated regulations governing the amount of volatile organic compounds that can be used in the products. Industrial regulations require a volatile organic compound content of less than 50%, and it is known that further reductions will follow, for example below 25%. Alternatively, naturally-occurring oils, such as plant-based oils, and derivatives thereof provide renewable and nontoxic, biodegradable ingredients that can be explored for use in industrial applications.

The invention provides a high-penetrating oil for reducing the effort required to loosen fittings. For example, as applied to fittings, the penetrating oil climbs the threads or similar components to diffuse the oil throughout the fittings and aid in disassembly. The penetrating oil benefits from the synergy of several biobased components to overcome the concerns associated with undesirable or toxic lubricant products, such as non-conforming petroleum-based or halogenated formulations.

SUMMARY

A penetrating oil composition including 40 to 80 weight percent of at least one long-chain, low-volatile ester derived from a natural plant-based oil, 20 to 40 weight percent of an unsulfurized terpene, 1 to 10 weight percent of a rust preventative and 1 to 10 weight percent of a propellant.

A penetrating oil composition including a combination of long-chain, low-volatile esters derived from a natural plant-based oil, said combination being present as follows: 5 to 9 weight percent hexadecanoic acid methyl ester; 2 to 4 weight percent octadecanoic acid methyl ester; 12 to 20 weight percent 9-octadecenoic acid (Z) methyl ester; 25 to 45 weight percent 9,12-octadecadienoic acid (Z,Z) methyl ester; and 3 to 6 weight percent 9,12,15-octadecatrienoic acid (Z,Z,Z) methyl ester, and 20 to 40 weight percent of at least one terpene and 1 to 10 weight percent of a rust preventative. The penetrating oil composition containing less than 50 weight percent of volatile organic compounds.

A penetrating oil composition including 60 to 80 weight percent of soybean methyl ester, 18 to 22 weight percent of unsulfurized orange terpene, 2 to 5 weight percent of a rust preventative and less than 5 weight percent of propellant. The penetrating oil composition containing less than 25 weight percent of volatile organic compounds.

DETAILED DESCRIPTION

As used herein, weight and percentages are weight percents based on total weight of the composition unless otherwise specifically indicated or apparent. When a range such as 5-25 or 5 to 25 is given, this means at least or greater than 5 and, separately and independently, not less than or greater than 25.

Biobased penetrating oil compositions are described herein, and preferably the biobased penetrating oil compositions contain a long-chain, low-volatile ester derived from a natural plant-based oil, an unsulfurized terpene and a rust preventative. The compositions described herein are adapted to the chemical characteristics related to penetrating ability such that the composition's ability to loosen rusted, corroded or otherwise tightly fitted components is equal to the performance of petroleum-based and/or chlorinated solvent based penetrants. Thus, the biobased penetrating oil composition's impact on the environment is acceptable and meets current and anticipated future industrial regulations related to the presence of volatile organic compounds. The term "biobased," as used herein, equally refers to "penetrating oil" without the precursor designation of biobased.

The penetrating oil as described herein may be diluted with additional solvents or propellants to provide a pump or spray penetrating oil product for providing excellent penetration of tightly fitted components or parts, enhanced lubricity properties and rust or corrosion resistance. Alternatively, the penetrating oil can be brushed on parts or fittings or can be submerged in a bath or container of the penetrating oil to coat the same. A preferred embodiment is an aerosolized version of the penetrating oil composition.

The components of the biobased penetrating oil compositions can be arranged as known in the art, for example, components can be separately blended into the base fluid or solvent or, alternatively, can be blended together in any number of subcombinations or entirely individually. It is preferred to blend the components in the low-volatile ester, or combination of esters, derived from a natural plant-based oil. For example, the terpene, rust preventative and any additional component, such as a water dispersant, is blended into a combination of long-chain methyl esters derived from soybean oil. The penetrating oils described herein can contain reduced amounts of volatile organic compounds, for example, the penetrating oil compositions can contain volatile organic compounds in the amount of 1 to 50, preferably 5 to 40, more preferably 10 to 30, or about 15, 20 or 25 weight percent. In particular, to meet current and future industrial regulations, the penetrating oil composition preferably contains less than 50, 40, 30, 25, 20 or 10 weight percent of volatile organic compounds.

As noted above, the biobased penetrating oil can contain at least one long-chain, low-volatile ester derived from a natural plant-based oil. Alternatively, a combination of long-chain, low-volatile esters or derivatives thereof can be present in the penetrating oil. The long-chain, low-volatile esters can be saturated (e.g., C18:0), unsaturated (e.g., C18:2) or a combination thereof. The long-chain, low-volatile esters can have a carbon chain greater than 12 carbons, and preferably the long-chain, low-volatile esters are $C_{16}$ to $C_{18}$ esters or derivatives thereof, such as a $C_{16}$ to $C_{18}$ methyl ester. For example, long-chain, low-volatile ester can be derived from soybean oil and be a saturated or unsaturated $C_{16}$-$C_{18}$ methyl ester. Soybean methyl esters can be obtained from the esterification of soybean oil and such fatty acid esters are non-toxic and biodegradable and thus contribute to the environmentally acceptable, biobased composition. The long-chain, low-volatile ester component, or combination of esters, can be present in the penetrating oil in an amount of 40 to 80, preferably 45 to 75, more preferably 50 to 70, or about 52 or 53 or about 70 or 71 weight percent. The natural plant-based oil used to derive the low-volatile ester or derivative thereof can be, for example, vegetable oils, soybean oil, palm oil, coconut oil, canola oil, castor oil, olive oil, flaxseed oil, or the like.

The at least one long-chain, low-volatile ester derived from a natural plant-based oil of the penetrating oil is preferably devoid of petroleum-based products, such as solvents, volatile organic compounds and/or halogenated products, such as cholorinated solvents. As can be appreciated, trace amounts of components can be present in a chemical composition, and thus, in an alternative manner, the long-chain, low-volatile ester component is preferably substantially free of petroleum-based solvents, volatile organic compounds and halogenated solvents. As used herein, substantially free denotes that the penetrating oil contains only trace amounts of a petroleum-based product, volatile organic compounds and/or halogenated product, such as, for example, the long-chain, low-volatile ester of the penetrating oil contains less than 1, preferably less than 0.5 or in the range of 0.01 to 0.1 weight percent of these toxic, non-environmentally friendly components.

In one embodiment, the penetrating oil can contain at least one, and preferably a combination of, long-chain, low-volatile esters selected from the group consisting of saturated or unsaturated $C_{18}$ fatty acid esters, such as octadecanoic acid esters or derivatives thereof and saturated or unsaturated $C_{16}$ fatty acid esters, such as hexadecanoic acid esters and derivatives thereof. Examples of octadecanoic acid esters include, but are not limited to, methyl esters of octadecanoic acid, such as octadecanoic acid methyl ester (e.g., C18:0); 9-octadecenoic acid (Z) methyl ester (e.g., C18:1); 9,12-octadecadienoic acid (Z,Z) methyl ester (e.g., C18:2) and 9,12,15-octadecatrienoic acid (Z,Z,Z) methyl ester (e.g., C18:3) or combinations thereof. Examples of hexadecanoic acid esters include, but are not limited to, methyl esters of hexadecanoic acid, such as hexadecanoic acid methyl ester (e.g., C16:0).

In another embodiment, the penetrating oil can contain a combination of methyl esters derived from soybean oil. For example, a combination of the following methyl esters and weight percents can be present in the penetrating oil, 5 to 9, or about 6, 7 or 8 weight percent hexadecanoic acid methyl ester (e.g., C16:0); 2 to 4, or about 2 or 3 weight percent octadecanoic acid methyl ester (e.g., C18:0); 12 to 20, 13 to 18 or about 15, 16 or 17 weight percent 9-octadecenoic acid (Z) methyl ester (e.g., C18:1); 25 to 45, 27 to 37 or about 30 weight percent 9,12-octadecadienoic acid (Z,Z) methyl ester (e.g., C18:2), and 3 to 6, or about 4 or 5 weight percent 9,12,15-octadecatrienoic acid (Z,Z,Z) methyl ester (e.g., C18:3). One example of a suitable soybean methyl ester is CAS NO. 67762-38-3 supplied by Peter Cremer North America, LP of Cincinnati, Ohio.

The penetrating oil can further contain at least one terpene, and in particular an unsulfurized, naturally occurring terpene or derivative thereof. For instance, suitable terpenes include diterpenes, triterpenes, and tetraterpenes which can be condensation products of modified or unmodified isoprene molecules. The terpenes may be mono-, bi-, tri-, or tetracyclic compounds with varying degrees of saturation. Additionally, terpene derivatives, e.g., alcohols, aldehydes, and the like, (e.g., terpenoids) may be used. Terpene or a combination of terpenes can be present in the penetrating oil composition in an amount of 20 to 50, preferably 20 to 40, about 20, 25, 30, 35 or 40 weight percent.

Preferably, natural plant-based terpenes contained in essential oils of many types of plants and flowers can be used. For example, natural products such as pine oil contains a mixture of alpha- and beta-terpineols and other terpene hydrocarbons. The specific ratios and amounts of the various components in a given pine oil terpene product will depend upon the particular source and the degree of purification. Another example is orange oil for providing orange terpenes including a mixture of terpenes that are available commercially from Florida Chemical, Givaudan-Roure and Danisco of Lakeland, Fla., such as orange terpenes (e.g., CAS NO. 8028-48-6).

Another example of a suitable terpene is limonene or a derivative thereof, which is a widely distributed optically active terpene having a formula of $C_{10}H_{16}$. Limonene occurs naturally in both d and l forms and a racemic mixture of both is known as dipentene, a colorless liquid. Limonene can be derived from citrus fruits such as lemon or orange, as well as bergamot, caraway and other oils such as peppermint and spearmint oils. Limonene and its isomers are nontoxic and considered to be acceptable components for lubricating oil products. Alternative derivatives of limonene can be limonene dioxide, dipentene dioxide, and limonene monoxide, dipentene monoxide and the like.

The penetrating oil can further contain at least one rust preventative. Examples of suitable rust preventatives include, but are not limited to, metal sulfonates, such as sodium, calcium and zinc sulphonates, zinc dinonylnapthalenesulfuonate, calcium dinonylnapthalenesulfonate, metal phosphates, such as zinc phosphates or zinc ($C_1$-$C_{14}$)alkyldithiophosphate (CAS. NO. 68649-42-3), tricresyl phosphate, didodecyl phosphate, metal phenate sulfides, fatty acids, acid phosphate esters, alkyl succinic acids, petroleum distillates, such as petroleum lube oil (e.g., CAS NO. 64742-65-0). Zinc dinonylnapthalenesulfuonate, zinc ($C_1$-$C_{14}$)alkyldithiophosphate and calcium dinonylnapthalenesulfonate are available commercially from Nanjung Samwon, China. The at least one rust preventative can be present in the penetrating oil in 1 to 10, 2 to 5, or about 3 or 4 weight percent.

In one embodiment, the penetrating oil can contain at least one, and preferably a combination of, rust preventatives. For example, the penetrating oil can contain 2 to 5, or about 3 or 4 weight percent of a petroleum distillate, 0.01 to 1, 0.025 to 0.5, or about 0.1 weight percent of zinc ($C_1$-$C_{14}$)alkyldithiophosphate, 0.01 to 1, 0.025 to 0.5, or about 0.3 weight percent of zinc dinonylnapthalenesulfuonate, and 0.01 to 1, 0.025 to 0.5, or about 0.3 weight percent of calcium dinonylnapthalenesulfonate.

As noted above, the penetrating oil can be adapted to be a pump or spray product, for example by the inclusion of a gaseous additive such as a propellant. The propellant functions to propel the penetrating oil and provides a spray for spray-on applications, such as to break loose nuts and bolts and to eliminate squeaks. In one embodiment, the penetrating oil contains at least one propellant in order to formulate an aerosol product. The penetrating oil can contain 0.1 to 20, preferably 1 to 10, more preferably 2 to 5, or about 3 or 4 weight percent of a propellant. Suitable non-flammable propellants include, but are not limited to, carbon dioxide or nitrogen gas. Alternative propellants can include compressed air and other condensed or compressed gases suitable for being used as aerosol propellants.

The penetrating oil can further contain at least one water dispersant. Examples of suitable water dispersants include, but are not limited to, glycol or derivatives thereof, such as glycol ethers, for example, ethylene glycol monobutyl ether. The penetrating oil can include a water dispersant in the amount of 0.01 to 1, 0.025 to 0.5, or about 0.3 weight percent. In one embodiment, the penetrating oil can include about 0.05 to 0.5, or about 0.3 weight percent of ethylene glycol monobutyl ether. The penetrating oil can further contain additional ingredients as know in the art as desired.

Examples 1 and 2

The following components are mixed together in the approximate weight percentages indicated below in Table 1 to prepare penetrating oil compositions as described herein. Formula 1 is Example 1 of the biobased penetrating oil and Formula 2 is Example 2 of the biobased penetrating oil.

TABLE 1

| Component | Example 1 - Formula 1 (weight percent) | Example 2 - Formula 2 (weight percent) |
|---|---|---|
| Soy methyl ester | 52.5 | 70.5 |
| Orange terpenes | 39.5 | 21.5 |
| Petroleum distillates | 4 | 4 |
| Carbon dioxide | 3 | 3 |
| Zinc dinoylnaphthalenesulfonate | 0.3 | 0.3 |
| Calcium dinoylnaphthalenesulfonate | 0.3 | 0.3 |
| Ethylene glycol monobutyl ether | 0.3 | 0.3 |
| zinc ($C_1$-$C_{14}$)alkyldithiophosphate | 0.1 | 0.1 |

Formulas 1 and 2 as indicated in Table 1 are environmentally acceptable penetrating oils conforming with industrial regulations for volatile organic compound content. For example, Formula 1 contains less than 50 weight percent of volatile organic compounds and Formula 2 contains less than 25 weight percent. The penetrating oil compositions of Formulas 1 and 2 provide the penetrating ability and the torque reduction required to loosen fittings equal to commercially available petroleum-based or chlorinated solvent penetrants that do not meet current and anticipated regulations regarding total content of volatile organic compounds. Accordingly, the penetrating oil compositions described herein provide biobased alternatives to toxic and unacceptable penetrants.

Although the preferred embodiments of the invention have been shown and described, it should be understood that one of ordinary skill in the art could consider various modifications and changes to adapt the penetrating oil composition to adapt the composition to various uses and conditions without departing from the scope of the invention as disclosed and claimed herein.

What is claimed is:

1. A penetrating oil composition comprising:

a) greater than 50 weight percent of a long-chain, low-volatile ester or combination of esters derived from a natural plant-based oil;

b) 20 to 40 weight percent of an unsulfurized terpene;

c) 1 to 10 weight percent of a rust preventative, and d) 1 to 10 weight percent of a propellant.

2. The penetrating oil composition of claim 1, said propellant being present in less than 5 weight percent and said propellant being carbon dioxide.

3. The penetrating oil composition of claim 1, said composition having less than 50 weight percent of volatile organic compounds.

4. The penetrating oil composition of claim 1, said composition having less than 25 weight percent of volatile organic compounds.

5. The penetrating oil composition of claim 1, wherein said at least one long-chain, low-volatile ester derived from a natural plant-based oil is substantially free of a petroleum-based solvent.

6. The penetrating oil composition of claim 4, said at least one long-chain, low-volatile ester being derived from soybean oil.

7. The penetrating oil composition of claim 5, said at least one long-chain, low-volatile ester derived from soybean oil being a saturated or unsaturated $C_{16}$-$C_{18}$ methyl ester.

8. The penetrating oil composition of claim 6, said saturated or unsaturated $C_{16}$-$C_{18}$ methyl ester being selected from the group consisting of hexadecanoic acid methyl ester; octadecanoic acid methyl ester; 9-octadecenoic acid (Z) methyl ester; 9,12-octadecadienoic acid (Z,Z) methyl ester and 9,12,15-octadecatrienoic acid (Z,Z,Z) methyl ester.

9. The penetrating oil composition of claim 1, said at least one long-chain, low-volatile ester derived from a natural plant-based oil being a combination of methyl ester components selected from the group consisting of hexadecanoic acid methyl ester; octadecanoic acid methyl ester; 9-octadecenoic acid (Z) methyl ester; 9,12-octadecadienoic acid (Z,Z) methyl ester and 9,12,15-octadecatrienoic acid (Z,Z,Z) methyl ester.

10. The penetrating oil composition of claim 1, said at least one long-chain, low-volatile ester derived from a natural plant-based oil being a combination of methyl ester components, said methyl ester components being present in said composition as:

a) 5 to 9 weight percent hexadecanoic acid methyl ester (C16:0);

b) 2 to 4 weight percent octadecanoic acid methyl ester (C18:0);

c) 12 to 20 weight percent 9-octadecenoic acid (Z) methyl ester (C18:1);

d) 25 to 45 weight percent 9,12-octadecadienoic acid (Z,Z) methyl ester (C18:2), and e) 3 to 6 weight percent 9,12,15-octadecatrienoic acid (Z,Z,Z) methyl ester (C18:3).

11. The penetrating oil composition of claim 1, said unsulfurized terpene being selected from the group consisting of orange terpenese, limonene or a derivative thereof, or a pine oil-based terpene or derivative thereof.

12. The penetrating oil composition of claim 1, said rust preventative being selected from the group consisting of zinc dinonylnapthalenesulfuonate, calcium dinonylnapthalenesulfonate, zinc alkyldithiophosphate, zinc ($C_1$-$C_{14}$)alkyldithiophosphate and a petroleum distillate.

13. The penetrating oil composition of claim 1, said rust preventative being present in said composition as:

a) 0.01 to 1 weight percent zinc dinonylnapthalenesulfuonate;

b) 0.01 to 1 weight percent zinc ($C_1$-$C_{14}$)alkyldithiophosphate;

c) 0.01 to 1 weight percent calcium dinonylnapthalenesulfonate, and d) 2 to 5 weight percent petroleum distillate.

14. A penetrating oil composition comprising:

a) a combination of long-chain, low-volatile esters derived from a natural plant-based oil, said combination being greater than 50 weight percent, said combination being 5 to 9 weight percent hexadecanoic acid methyl ester, 2 to 4 weight percent octadecanoic acid methyl ester, 12 to 20 weight percent 9-octadecenoic acid (Z) methyl ester, 25 to 45 weight percent 9,12-octadecadienoic acid (Z,Z) methyl ester, and 3 to 6 weight percent 9,12,15-octadecatrienoic acid (Z,Z,Z) methyl ester, b) 20 to 40 weight percent of at least one terpene, and c) 1 to 10 weight percent of a rust preventative.

15. The penetrating oil composition of claim 14, said composition further comprising a water dispersant.

16. The penetrating oil composition of claim 15, said water dispersant being present at less than 1 weight percent of said composition.

17. The penetrating oil composition of claim 14, said rust preventative being present in said composition as:

a) 0.01 to 1 weight percent zinc dinonylnapthalenesulfuonate;

b) 0.01 to 1 weight percent zinc ($C_1$-$C_{14}$)alkyldithiophosphate;

c) 0.01 to 1 weight percent calcium dinonylnapthalenesulfonate, and d) 2 to 5 weight percent petroleum distillate.

18. The penetrating oil composition of claim 14, said composition being substantially free of short-chain fatty acids or derivatives thereof.

19. A penetrating oil composition comprising 60 to 80 weight percent of soybean methyl ester, 18 to 22 weight percent of unsulfurized orange terpene, 2 to 5 weight percent of a rust preventative and less than 5 weight percent of propellant.

20. The penetrating oil composition of claim 19, said soybean methyl ester being present as a combination of hexadecanoic acid methyl ester, octadecanoic acid methyl ester, 9-octadecenoic acid (Z) methyl ester, 9,12-octadecadienoic acid (Z,Z) methyl ester and 9,12,15-octadecatrienoic acid (Z,Z,Z) methyl ester, said rust preventative being present as a combination of petroleum distillate, zinc ($C_1$-$C_{14}$)alkyldithiophosphate, zinc dinonylnapthalenesulfuonate and calcium dinonylnapthalenesulfonate, and said propellant being carbon dioxide, wherein said composition contains less than 25 weight percent of volatile organic compounds.

* * * * *